US006039461A

United States Patent [19]

Cummings et al.

[11] Patent Number: 6,039,461

[45] Date of Patent: Mar. 21, 2000

[54] COMPACT HIGH-INTENSITY LIGHTING ASSEMBLY

[75] Inventors: Tom Cummings, Jackson; David Nowak, Dexter; Byung Jin Chang, Ann Arbor, all of Mich.

[73] Assignee: General Scientific Corporation, Ann Arbor, Mich.

[21] Appl. No.: 09/151,524

[22] Filed: Sep. 11, 1998

[51] Int. Cl.[7] ..... F21L 15/04

[52] U.S. Cl. ..... 362/287; 362/294; 362/105

[58] Field of Search ..... 362/103, 105, 362/369, 390, 804, 396, 287, 427, 418, 263, 294, 373, 106

[56] References Cited

U.S. PATENT DOCUMENTS

| | | | |
|---|---|---|---|
| 3,951,139 | 4/1976 | Kloots | 128/23 |
| 4,090,232 | 5/1978 | Golden | 362/106 |
| 4,104,709 | 8/1978 | Kloots | 362/105 |
| 4,429,351 | 1/1984 | Petzl et al. | 362/187 |
| 4,616,297 | 10/1986 | Liu | 362/105 |
| 4,631,644 | 12/1986 | Dannhauer | 362/105 |
| 4,631,645 | 12/1986 | Lenart | 362/105 |
| 4,794,496 | 12/1988 | Lanes et al. | 362/105 |
| 4,797,793 | 1/1989 | Fields | 362/105 |
| 4,887,194 | 12/1989 | Fields | 362/105 |
| 5,341,513 | 8/1994 | Klein et al. | 2/9 |
| 5,355,285 | 10/1994 | Hicks | 362/32 |
| 5,386,592 | 2/1995 | Checkeroski | 2/209.13 |
| 5,430,620 | 7/1995 | Li et al. | 362/32 |
| 5,440,462 | 8/1995 | Kim et al. | 362/105 |
| 5,463,538 | 10/1995 | Womack | 362/106 |
| 5,667,291 | 9/1997 | Caplan | 362/105 |
| 5,676,449 | 10/1997 | Newsome | 362/106 |
| 5,853,242 | 12/1998 | Bouffay et al. | 362/105 |

*Primary Examiner*—Thomas M. Sember

*Attorney, Agent, or Firm*—Gifford, Krass, Groh, Sprinkle, Anderson & Citkowski, PC

[57] ABSTRACT

A compact, high-intensity light assembly including a substantially hollow shell having a distal end from which the light emerges and a proximal end into which a base unit inserts. A lamp guide holds the light source in a central position within the shell using a spring which urges a rear portion of the lamp guide against an annular seating lip on the base unit. The lamp guide preferably includes a necked-down portion having an inner surface which makes holding contact with the outer surface of the light source, and an outer surface including heat-radiating features. In a preferred embodiment, the base unit is insertable into the proximal end of the shell by way of a threaded connection, enabling the lamp guide and light source to be adjustably moved relative to the distal end of the shell so as to focus the light from the source into a preferred illumination area. The preferred embodiment also includes a shield bracket attached to the proximal end of the shell and a fastening clip attached to the shield bracket facilitating at least two adjustable degrees of freedom.

7 Claims, 2 Drawing Sheets

COMPACT HIGH-INTENSITY LIGHTING ASSEMBLY

FIELD OF THE INVENTION

The present invention relates to high-intensity illumination assemblies of the type used in the medical and dental professions and, more particularly, to an improved, lightweight source of localized, intense illumination within an adjustable area.

BACKGROUND OF THE INVENTION

Head-mounted illumination systems are often used by dentists, surgeons, ophthalmologists, and other practitioners when performing examinations and medical procedures. Certain advantages of such systems is that they leave the hands free while projecting illumination in the same direction the user is looking.

Most head-mounted illumination systems use standard flashlight technology; that is, a filament-based lamp in conjunction with a back reflector. Such an arrangement does not provide very uniform illumination. Even those systems which use very expensive and precision reflectors have difficulty producing a clean and uniform beam of light and the illumination, to the extent that it is uniform, is not maintained over a long focal range. Reflector-based systems also produce considerable stray light, and are therefore inefficient.

A uniform, intense illumination area can be produced using a fiber-optic illuminators, in which case a high-intensity light source feeds an optical fiber bundle. However, the user must be constantly attached via a tether to the heavy fiber bundle which is, in turn, anchored to an illuminator box that must be plugged into a power outlet. Thus, the mobility and comfort of the wearer is significantly reduced.

An ordinary imaging illuminator, using a standard bulb and an imaging lens, may alternatively be employed, but this arrangement exhibits a low collection efficiency and produces a relatively dim light beam. The magnified image of the bulb filament in the illumination plane also tends to produce a very uneven light structure.

Commonly assigned U.S. Pat. No. 5,440,642 improves upon the prior art by providing a head-mounted lighting assembly which produces a uniform, intense and adjustable light beam. The assembly may be easily mounted upon a head of a user, either on a headband or a spectacle frame. However, due to the heat-dissipation aspects of the configuration disclosed therein, the illumination system requires a subassembly including a low-pass heat filter which tends to reduce the light output while blocking forwarding-projecting heat. The base of the assembly described in the '462 patent must be disconnected with a plurality of screws, which causes bulb replacement to be somewhat cumbersome.

The need continues to remain, therefore, for a compact, portable, lightweight illumination system wherein the majority of heat dissipation occurs through the middle portion of the assembly for more uniform cooling. A preferred design would eliminate technical problems associated with bulb replacement and reduce the number of optical components for higher efficiency. When mounted on the head of a user via a headband or spectacle frames, an improved implementation should prevent contact with a user's forehead while providing additional degrees adjustment for enhanced operational flexibility.

SUMMARY OF THE INVENTION

The present invention resides in an improved compact, high-intensity light assembly. The assembly includes a substantially hollow shell having proximal and distal ends within which a high-intensity light source, preferably a halogen lamp, is centrally retained. The light source has a proximal end connected to electrical wiring which exits the through the proximal end of the shell, and a distal end which emits light toward and through the distal end of the shell.

The light from the source is emitted along an optical axis through a lens assembly retained within the distal end of the shell. In the preferred embodiment the lens assembly includes only an optical diffuser and a lens for focussing the light from the source into a preferred illumination area. Further elements such as optically transparent heat shields and the like are unnecessary.

A base unit inserts into the proximal end of the shell. The base unit includes an apertured proximal end through which the electrical wiring emerges and a distal end including an annular seating lip. A lamp guide is used to hold the light source in a central position within the shell with a proximal lip configured to rest against the annular seating lip of the base unit, and a spring disposed within the shell urges the proximal lip of the lamp guide against the annular seating lip of the base unit. The lamp guide preferably includes a necked-down portion having an inner surface which makes holding contact with the outer surface of the light source, and an outer surface including heatradiating features.

In a preferred embodiment, the base unit is insertable into the proximal end of the shell by way of a threaded connection, enabling the lamp guide and light source to be adjustably moved relative to the distal end of the shell so as to focus the light from the source into the preferred illumination area. The preferred embodiment also includes a shield bracket attached to the proximal end of the shell and a fastening clip attached to the shield bracket. The fastening clip may be used to removably attach the lighting assembly to the bridge portion of a pair of eyeglass frames or headband mount. In the preferred embodiment the fastening clip is attached to the shield bracket so as to provide a first adjustable degree of freedom along a pivoting axis transverse to the optical axis, and a second adjustable degree of freedom with respect to a swiveling axis parallel and spaced apart from the optical axis.

BRIEF DESCRIPTION OF THE DRAWINGS

FIG. 1D is a front-view drawing of the compact high-intensity light assembly, indicating a section through which FIG. 2 is a cross-sectional, side-view drawing of the compact, high-intensity light assembly, as indicated with respect to FIG. 1D.

DETAILED DESCRIPTION OF THE INVENTION

Figure 1A:
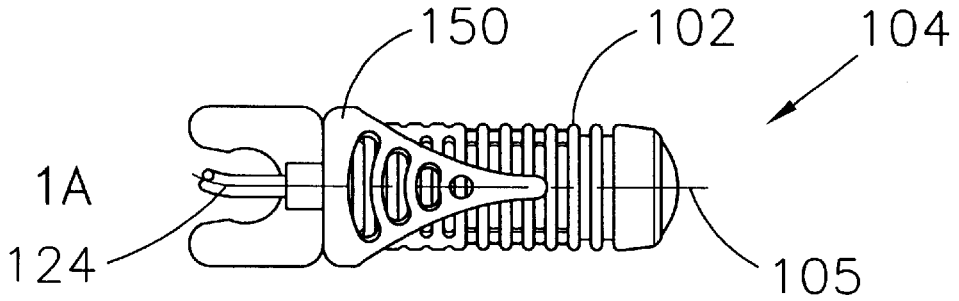
FIG. 1A is a top-view outline drawing of a compact high-intently light assembly according to the invention.

Now making reference to the drawings, FIG. 1A illustrates a top-view drawing of a lightweight, compact high-intensity light assembly according to the invention. Broadly, as is visible from this perspective, the assembly includes an outer shell 102 having a proximal end from which an electrical power cable 124 emerges, and a distal end incorporating a light assembly 104 having an optical axis 105, the details of which are better understood with respect to FIG. 2.

Also evident in the top view of FIG. 1A is the incorporation of a shield bracket 150 which interconnects to a retainer clip 156 and associated assembly facilitating two degrees of adjustable orientation.

Figure 1B:
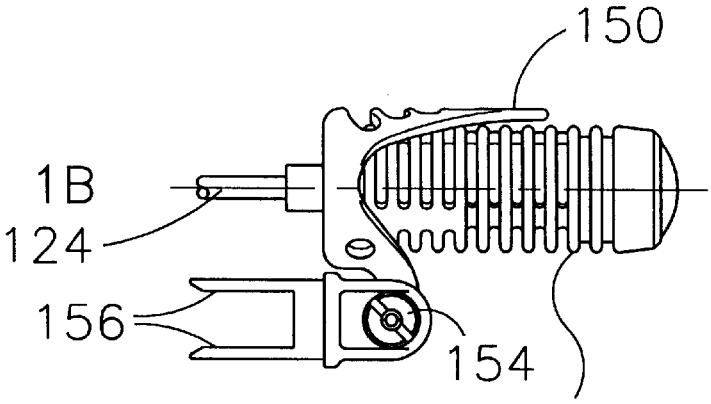
FIG. 1B is a side-view drawing of the compact high-intensity light assembly.

FIG. 1B is a side-view drawing of the overall assembly, which better illustrates an adjustable pivot point 154, enabling a first degree of adjustable orientation; that is, an up-and-down or rotational elevation about a pivot axis which is perpendicular to the optical axis 105. Note that the body of the shell 102 includes heat-radiative features and perforations which enter into the body of the shell to provide enhanced heat dissipation. The upper portion of the shield bracket 150 also preferably includes apertures to increase surface area and heat dissipation.

Figure 1D:
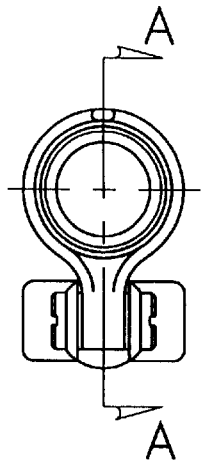
Figure 1C:
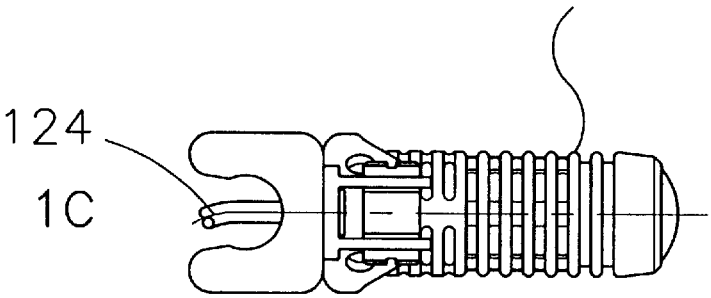
FIG. 1C is a bottom-view drawing of the compact high-intensity light assembly.
Figure 2:
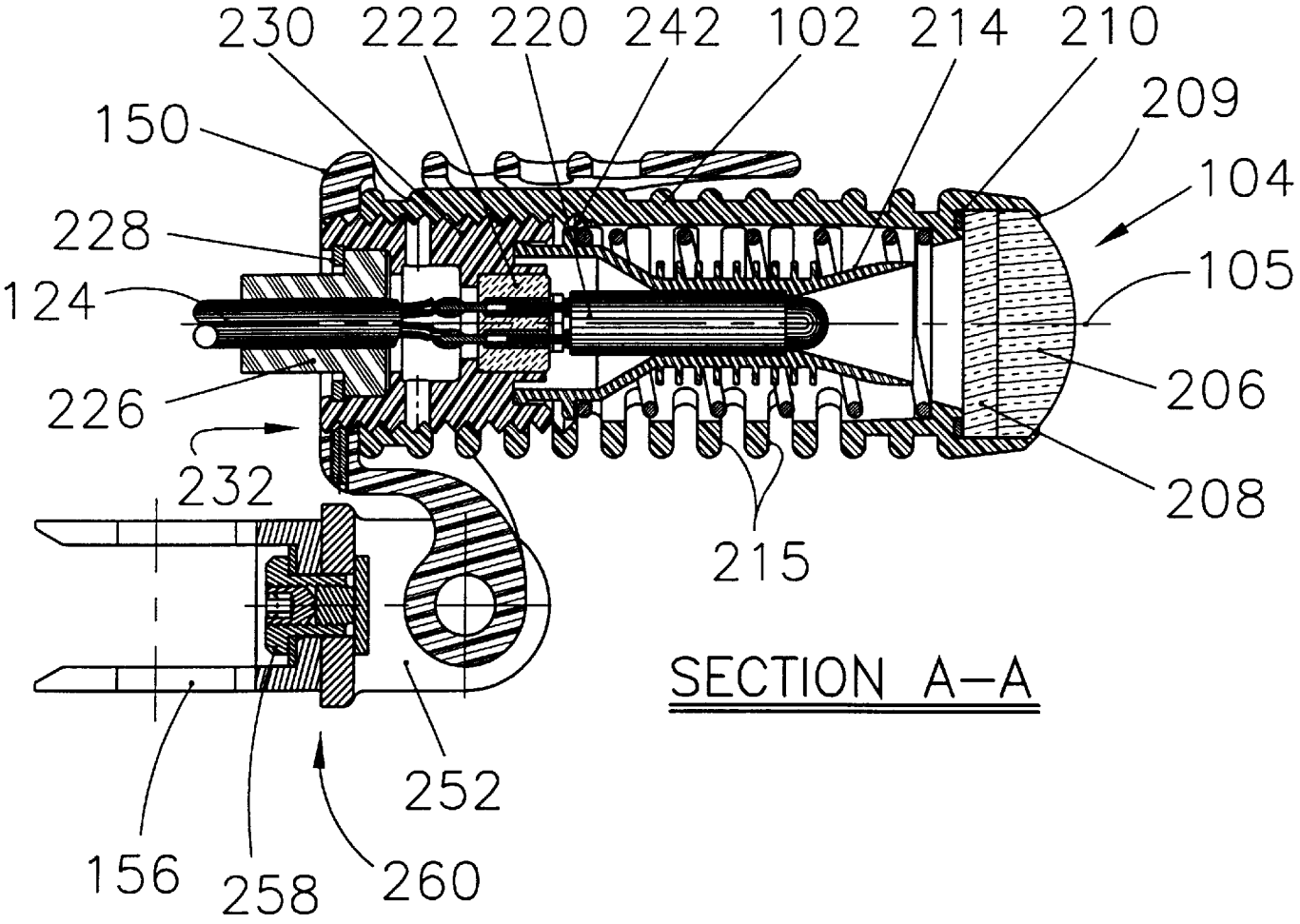
FIG. 2 is derived.

FIG. 1C is a bottom-view drawing of the assembly, and FIG. 1D shows a frontal view wherein section line A—A is located as a point of reference for further discussion with respect to FIG. 2.

Now turning to FIG. 2, the section A—A is presented as an engineering drawing revealing additional features, advantages and improvements made possible by the invention. As evident from the drawing, the shell 102 essentially comprises a miniature hollow body, preferably cylindrical, into which, at the distal end, the lens assembly 104 is installed. This assembly 104 preferably consists of an outer lens element 206 responsible for beam shaping, and a diffuser 208 which may be of conventional design. Note that, in lieu of separate elements, the back side of the lens 206 may be appropriately modified to provide a diffusing function in a single element.

The elements 206 and 208 are sandwiched together in intimate cooperation to form the overall lens assembly 104, and are held in place with an annular clip retaining ring 209 formed around an inner portion of the shell 102. Space is also provided for an O-ring 210 against which the optical elements are compressed, thereby facilitating a tight, preferably moisture-resistant seal.

The lamp itself 220, which is preferably halogen though other high-intensity sources may be utilized as appropriate, is held in place with a lamp guide 214 which includes a central necked-down portion which actually makes contact with the outer wall of the bulb 220. The base electrodes of the bulb 220 fit into a socket 222 which, in turn, makes electrical connection to wiring 124. The wiring 124 extends through and exits the assembly through a rubber bushing 226 which is held in place utilizing a snap ring 228.

The bushing and snap ring 228 fit into a base element 230 which is threaded in the vicinity of 231, and fits into the proximal end of the shell 102, which is also threaded for cooperative engagement. It should be noted that the threading serves dual purposes; not only does it facilitate removal of the base unit for bulb replacement, but through partial rotation, the lamp 220 is moved relative to the lens assembly 104, thereby adjusting focus of the emitted beam.

The lamp guide 214 carrying bulb 220 is held against the base 230 with a spring 240, biased to urge a lip on the lamp base against a distal ridge formed on the base. A washer 242 is used so that the spring applies a uniform pressure thereto. The urging of the lamp holder against the base causes the lamp within the holder to remain centrally located within the assembly overall, such that the heat fins 215 on the lamp guide 214 radiate uniformly into a small ambient environment contained within the shell.

This build-up of heat is, in turn, distributed evenly to the inner walls of the shell, which then enables the thermal conduction to occur uniformly through the shell and through the apertures formed therein.

The shield bracket 150 preferably encloses at least a portion of the proximal end of the assembly, and is attached to an area surrounding that portion of the assembly through which the power cable 124 and rubber bushing 236 emerge. A portion of the shield bracket extends downwardly as shown in the drawings to accommodate a pivot point 254 which, in turn, is coupled to a swivel bracket 252. The swivel bracket 252 connects to a clip portion 156 through a swivel bearing, which is tightenable through fastener 258 to permit an adjustable degree of swiveling about the interface 260. Accordingly, in conjunction with the pivot point 254 and swivel joint, the assembly facilitates two degrees of adjustable orientation.

There has thus been described a compact, lightweight high-intensity lighting assembly which offers several significant improvements over the prior art. In addition to reduced weight, this assembly features improved heat dissipation through the use of a more advanced isolation of the lamp itself which is the source of heat. The lens assembly obscures the optical elements less than previously, thereby facilitating a greater light output, while affording relatively straightforward bulb changing in the event of a burnout. The improved method of heat isolation and dissipation helps to prevent direct contact of high-temperature components from contacting the user directly. For example, with the lamp coupled to a pair of flip-up type oculars or spectacles as described in U.S. Pat. No. 5,381,263 such that, even in a flipped-up condition, the parts touching the user's forehead exhibit a reduced temperature due to the heat guard capability of the invention. In addition, the use of a double-pivot allows precise alignment of the beam to the line of the user's sight, as opposed to prior-art devices, which provide only one degree of freedom, if any.

We claim:

1. A compact, high-intensity light assembly, comprising:

a substantially hollow shell having proximal and distal ends;

a high-intensity light source retained centrally within the shell, the light source having a proximal end connected to electrical wiring which exits through the proximal end of the shell and a distal end which emits light toward and through the distal end of the shell, the light emitted by the source defining an optical axis;

a lens assembly retained within the distal end of the shell, the lens assembly including an optical diffuser and a lens for focussing the light from the source into a preferred illumination area;

a base unit insertable into the proximal end of the shell, the base unit having an apertured proximal end through which the electrical wiring emerges and a distal end including an annular seating lip;

a lamp guide used to hold the light source in a central position within the shell, the lamp guide including a proximal lip configured to rest against the annular seating lip of the base unit; and a spring disposed within the shell, the spring having a distal end retained within the shell and a proximal end urging the proximal lip of the lamp guide against the annular seating lip of the base unit.

2. The compact, high-intensity light assembly as set forth in claim 1, wherein the base unit is insertable into the proximal end of the shell by way of a threaded connection, the threaded connection enabling the lamp guide and light source to be adjustably moved relative to the distal end of the shell so as to focus the light from the source into the preferred illumination area.

3. The compact, high-intensity light assembly as set forth in claim 1, further including:

a shield bracket attached to the proximal end of the shell; and a fastening clip attached to the shield bracket.

4. The compact, high-intensity light assembly as set forth in claim 3, wherein the fastening clip is attached to the shield bracket so as to provide at least one adjustable degree of freedom therebetween.

5. The compact, high-intensity light assembly as set forth in claim 4, wherein the fastening clip is attached to the shield bracket so as to provide:

a first adjustable degree of freedom along a pivoting axis transverse to the optical axis; and a second adjustable degree of freedom with respect to a swiveling axis parallel and spaced apart from the optical axis.

6. The compact, high-intensity light assembly as set forth in claim 1, wherein the lamp guide includes a necked-down portion having an inner surface which makes contact with the outer surface of the high-intensity light, and an outer surface including heat-radiating features.

7. The compact, high-intensity light assembly as set forth in claim 1, wherein the high-intensity light source is a halogen light source.

* * * * *

UNITED STATES PATENT AND TRADEMARK OFFICE

CERTIFICATE OF CORRECTION

PATENT NO. : 6,039,461
DATED : Mar. 21, 2000
INVENTOR(S) : Tom Cummings, David Nowak, and Byung Jin Chang

It is certified that error appears in the above-identified patent and that said Letters Patent is hereby corrected as shown below:

Column 1, line 40 - Replace "5,440,642" with --5,440,462--

Column 3, line 20 - Replace "exits the through" with --exits through--

Column 3, line 47 - Replace "bushing and" with --bushing 226 and--

Column 3, line 48 - Replace "231" with 232"

Column 4, line 4 - Replace "236" with --226--

Signed and Sealed this

Tenth Day of April, 2001

*Attest:*

Nicholas P. Godici

NICHOLAS P. GODICI

*Attesting Officer*

*Acting Director of the United States Patent and Trademark Office*